US009400449B1

(12) United States Patent
Hagiwara et al.

(10) Patent No.: US 9,400,449 B1
(45) Date of Patent: Jul. 26, 2016

(54) IMAGE FORMING APPARATUS, IMAGE FORMING METHOD, AND NON-TRANSITORY COMPUTER READABLE MEDIUM

(71) Applicant: FUJI XEROX CO., LTD., Tokyo (JP)

(72) Inventors: Chihiro Hagiwara, Kanagawa (JP); Yoshifumi Ozaki, Kanagawa (JP); Takuya Iwamura, Kanagawa (JP); Shinji Mitsui, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/845,724

(22) Filed: Sep. 4, 2015

(30) Foreign Application Priority Data

Mar. 6, 2015 (JP) ..... 2015-044529

(51) Int. Cl.
*G03G 15/10* (2006.01)
*G03G 15/08* (2006.01)
*G03G 15/00* (2006.01)

(52) U.S. Cl.
CPC ..... *G03G 15/0824* (2013.01); *G03G 15/553* (2013.01); *G03G 15/0887* (2013.01)

(58) Field of Classification Search
CPC ..... G03G 15/0824; G03G 15/0887; G03G 15/5041; G03G 15/556; G03G 21/10
USPC ..... 399/27, 29, 58
See application file for complete search history.

(56) References Cited

U.S. PATENT DOCUMENTS 4,768,055 A * 8/1988 Takamatsu ..... G03G 15/0822 399/102
5,970,276 A * 10/1999 Kato ..... G03G 15/0887 399/29
7,366,457 B2 * 4/2008 Ono ..... G03G 21/10 399/344
2004/0008999 A1 * 1/2004 Iino ..... G03G 15/0121 399/29
2004/0213603 A1 * 10/2004 Shigeta ..... G03G 15/0877 399/254
2005/0063715 A1 * 3/2005 Suzuki ..... G03G 15/0822 399/27

FOREIGN PATENT DOCUMENTS

JP 2000-122354 A 4/2000
JP 2005-017631 A 1/2005

* cited by examiner

*Primary Examiner* — Benjamin Schmitt
(74) *Attorney, Agent, or Firm* — Oliff PLC

(57) ABSTRACT

An image forming apparatus includes a latent image forming unit, a developing unit, replenishing unit, and a control unit. The latent image forming unit forms an electrostatic latent image corresponding to an image information signal on an image carrier. The developing unit develops the electrostatic latent image using a two-component developer in which magnetic carriers are mixed with toner to form a visible image. The replenishing unit replenishes the toner to the developing unit. The control unit controls switching between first processing, which includes idling processing for replenishing at least part of residual toner, which is to be replenished to the developing unit and remains without being replenished to the developing unit, to the developing unit and stirring the toner within the developing unit, and second processing, which includes the idling processing and density correction processing for correcting a density of the toner within the developing unit.

10 Claims, 8 Drawing Sheets

IMAGE FORMING APPARATUS, IMAGE FORMING METHOD, AND NON-TRANSITORY COMPUTER READABLE MEDIUM

CROSS-REFERENCE TO RELATED APPLICATIONS

This application is based on and claims priority under 35 USC 119 from Japanese Patent Application No. 2015-044529 filed Mar. 6, 2015.

BACKGROUND (i) Technical Field

The present invention relates to an image forming apparatus, an image forming method, and a non-transitory computer readable medium.

(ii) Related Art

In recent years, cost of developing devices has been reduced, and the amount of toner in the developing devices has been reduced accordingly. However, for replenishment of toner according to the consumption of toner, in particular, in the case where the amount of toner in a developing device is small, when images with a high area coverage are continuously printed, the replenishment amount of toner may not catch up with the toner consumption, and the toner density may decrease. In such a case, normally, measures to increase the frequency of correction of the toner density are taken. However, increasing the frequency of correction of the toner density may reduce the productivity of image formation.

SUMMARY

According to an aspect of the invention, there is provided an image forming apparatus including a latent image forming unit, a developing unit, replenishing unit, and a control unit. The latent image forming unit forms an electrostatic latent image corresponding to an image information signal on an image carrier. The developing unit develops the electrostatic latent image using a two-component developer in which magnetic carriers are mixed with toner to form a visible image. The replenishing unit replenishes the toner to the developing unit. The control unit controls switching between first processing and second processing, the first processing including idling processing for replenishing at least part of residual toner, which is to be replenished to the developing unit and remains without being replenished to the developing unit, to the developing unit and stirring the toner within the developing unit, the second processing including the idling processing and density correction processing for correcting a density of the toner within the developing unit.

BRIEF DESCRIPTION OF THE DRAWINGS

Exemplary embodiments of the present invention will be described in detail based on the following figures, wherein.

DETAILED DESCRIPTION

First Exemplary Embodiment

Hereinafter, an exemplary embodiment of the present invention will be described in detail with reference to drawings. The case where the present invention is applied to a so-called tandem-type full-color image forming apparatus which employs an electrophotographic system will be described below.

First, a configuration of an image forming apparatus 10 according to an exemplary embodiment will be described with reference to FIG. 1. Hereinafter, Y represents yellow, M represents magenta, C represents cyan, and K represents black. In the case where component parts need to be distinguished from one another according to their colors, explanation will be provided such that color signs (Y, M, C and K) are added to the ending of corresponding reference signs. Furthermore, in the explanation provided below, in the case where the component parts are generically referred to without being distinguished among them, the color signs at the ending of corresponding reference signs will be omitted.

Figure 1:
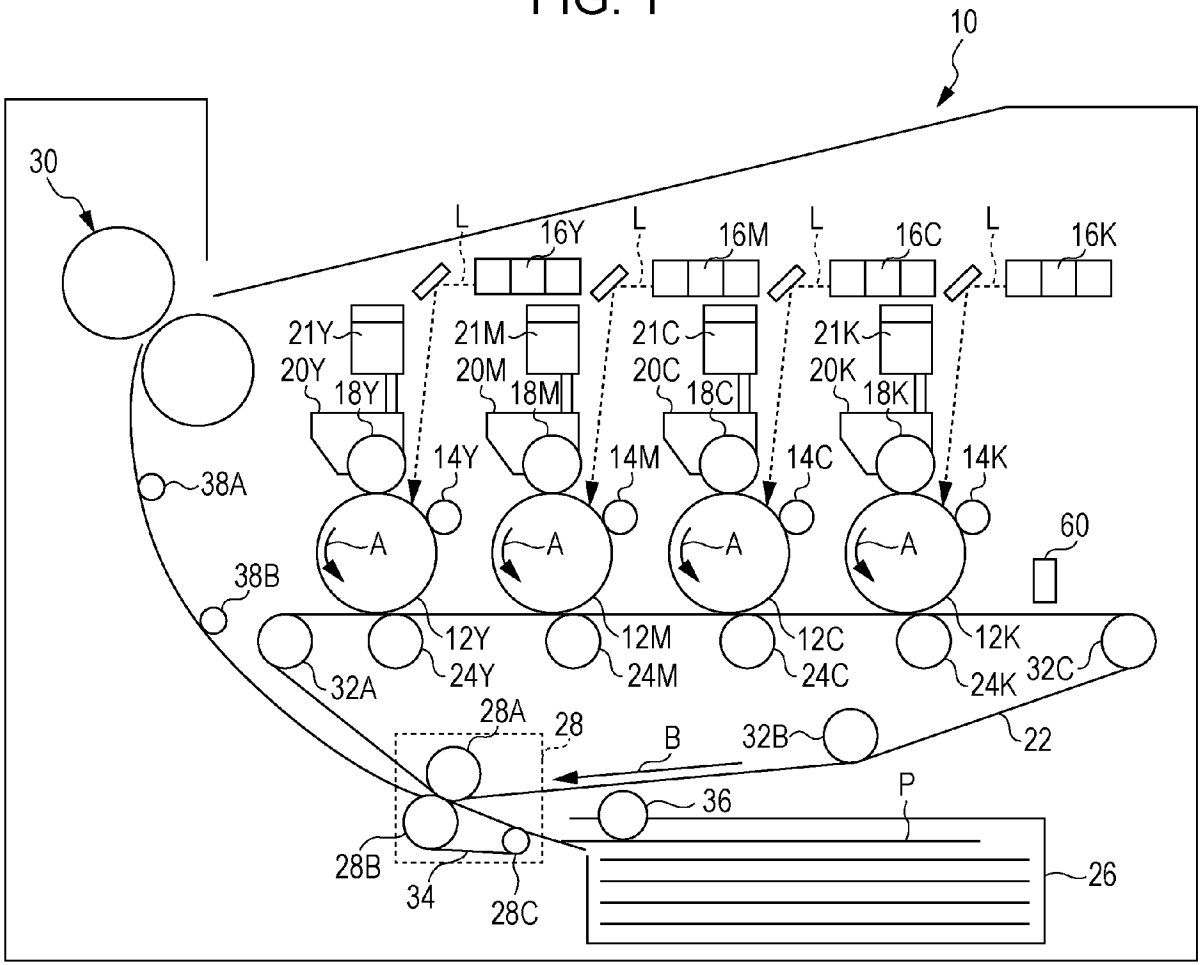
FIG. 1 is a schematic configuration diagram (a cutaway side view) illustrating a configuration of an image forming apparatus according to an exemplary embodiment.

The image forming apparatus 10 according to the first exemplary embodiment includes photoreceptors 12Y, 12M, and 12C, and 12K which are four image carriers rotating in the direction of arrows A in FIG. 1, for Y, M, C, and K, respectively. The image forming apparatus 10 also includes charging devices 14Y, 14M, 14C, and 14K which apply charging bias to electrically charge the surface of the corresponding photoreceptors 12.

The image forming apparatus 10 also includes laser output units 16Y, 16M, 16C, and 16K which cause the surface of the electrically charged photoreceptors 12 to be exposed to exposure light modulated based on image information of corresponding colors and form electrostatic latent images on the photoreceptors 12. The image forming apparatus 10 also includes developing rollers 18Y, 18M, 18C, and 18K which hold developer (toner) of corresponding colors.

The image forming apparatus 10 also includes a developing bias power source, which is not illustrated in FIG. 1. The image forming apparatus 10 also includes developing devices 20Y, 20M, 20C, and 20K which develop the electrostatic latent images on the photoreceptors 12 using toner of corresponding colors to form toner images on the photoreceptors 12 by applying developing bias to the developing rollers 18Y, 18M, 18C, and 18K, respectively. A stirring member, which is not illustrated in FIG. 1, for stirring replenished toner is provided in each of the developing devices 20. The toner discharged into the developing device 20 is stirred by the stirring member so that the toner density becomes uniform.

The image forming apparatus 10 also includes toner replenishment tanks 21Y, 21M, 21C, and 21K which store therein toner and replenish the stored toner to the developing devices 20Y, 20M, 20C, and 20K, respectively. The toner replenishment tanks 21 each include a screw, which is not illustrated in FIG. 1, for discharging the stored toner at a constant replenishment speed by rotating at a constant speed and replenishing the toner to the developing device 20.

The image forming apparatus 10 also includes first transfer devices 24Y, 24M, 24C, and 24K which transfer toner images of corresponding colors on the photoreceptors 12 to an intermediate transfer belt 22.

The image forming apparatus 10 also includes a paper housing unit 26 which houses paper P as a recording medium, and a second transfer device 28 which transfers the toner images on the intermediate transfer belt 22 to the paper P. The image forming apparatus 10 also includes a fixing device 30 which fixes the toner images transferred to the paper P, and a belt cleaner, which is not illustrated in FIG. 1, for cleaning toner remaining on the surface of the intermediate transfer belt 22 after the toner images are transferred to the paper P. The image forming apparatus 10 also includes a cleaner, which is not illustrated in FIG. 1, for cleaning the surface of each of the photoreceptors 12, and a discharging device, which is not illustrated in FIG. 1, for discharging electric charges remaining on the surface of each of the photoreceptors 12.

The image forming apparatus 10 also includes a density sensor 60 which detects the density of a toner image transferred to the intermediate transfer belt 22. In the first exemplary embodiment, a reflective-type optical sensor that includes a light-emitting element and a light-receiving element is used as the density sensor 60. However, the present invention is not limited to this. A known sensor which is capable of detecting the density of a toner image may be used.

Next, image forming processing performed by the image forming apparatus 10 according to the first exemplary embodiment will be described.

When image information which indicates an image to be formed is input, the image forming apparatus 10 applies charging bias to the charging devices 14, so that the surfaces of the photoreceptors 12 are charged to the negative polarity.

Meanwhile, after dissolving the image information into image information of Y, M, C, and K, the image forming apparatus 10 outputs modulation signals based on the image information of the individual colors to laser output units 16 of the corresponding colors. The laser output units 16 output laser beams L which have been modulated in accordance with the received modulation signals.

The laser beams L which have been modulated and output are applied to the surfaces of the photoreceptors 12. The surfaces of the photoreceptors 12 are in a state being electrically charged by the charging devices 14 to the negative polarity. When the laser beams L are applied to the surfaces of the photoreceptors 12, electric charges on portions irradiated with the laser beams L vanish, and electrostatic latent images corresponding to the image information of Y, M, C, and K on the corresponding photoreceptors 12.

When the electrostatic latent images formed on the photoreceptors 12 reach the developing devices 20, developing bias is applied by developing bias power sources, which are not illustrated in FIG. 1, to the developing rollers 18 inside the developing devices 20. Then, toner of the individual colors held on the circumferential faces of the developing rollers 18 adheres to the electrostatic latent images on the photoreceptors 12, and toner images corresponding to the image information of the individual colors are formed on the photoreceptors 12.

Furthermore, rollers 32A to 32C and a backup roller 28A of the second transfer device 28 are rotated by a motor, which is not illustrated in FIG. 1. Thus, the intermediate transfer belt 22 is conveyed to a space which is formed by the first transfer devices 24 and the photoreceptors 12, and the intermediate transfer belt 22 is pressed against the photoreceptors 12. At this time, when first transfer bias is applied by the first transfer devices 24, the toner images of the individual colors formed on the photoreceptors 12 are transferred to the intermediate transfer belt 22. In this case, the rotation of the rollers 32A to 32C and the backup roller 28A is controlled so that the transfer start positions on the intermediate transfer belt 22 for the toner images of the individual colors are the same. By superimposing the toner images of the individual colors as described above, toner images corresponding to the image information are formed on the intermediate transfer belt 22. In FIG. 1, the conveyance direction of the intermediate transfer belt 22 is represented by arrow B.

After the toner images are transferred from the photoreceptors 12 to the intermediate transfer belt 22, adhered materials, such as residual toner, adhered onto the surfaces of the photoreceptors 12 are removed by the cleaners, and residual electric charges are removed by discharging devices.

The second transfer device 28 includes, for example, the backup roller 28A which supports the intermediate transfer belt 22, a second transfer roller 28B that nips the paper P, together with the backup roller 28A, and an auxiliary roller 28C. The second transfer device 28 also includes a second transfer belt 34 which stretches over the second transfer roller 28B and the auxiliary roller 28C and conveys the paper P following the rotation of the second transfer roller 28B. When the second transfer roller 28B is made in contact with the intermediate transfer belt 22, the second transfer roller 28B rotates following the conveyance of the intermediate transfer belt 22.

Furthermore, when a paper conveyance roller 36 is rotated by a motor, which is not illustrated in FIG. 1, the paper P inside the paper housing unit 26 is conveyed to a space which is formed by the backup roller 28A and the second transfer roller 28B.

When the paper P is sandwiched between the backup roller 28A and the second transfer roller 28B while facing the face of the intermediate transfer belt 22 on which toner images are formed, second transfer bias is supplied to the backup roller 28A. Furthermore, the toner images formed on the intermediate transfer belt 22 are transferred to the paper P. Then, the paper P is conveyed by intermediate conveyance rollers 38A and 38B to the fixing device 30. The fixing device 30 heats and melts the toner images transferred to the paper P, and the toner images are thus fixed to the paper P.

Meanwhile, adhered materials, such as residual toner, adhered onto the surface of the intermediate transfer belt 22, through which the toner images are transferred to the paper P, are removed by the belt cleaner.

Next, a configuration of electrical principal portions of the image forming apparatus 10 according to the first exemplary embodiment will be described with reference to FIG. 2.

Figure 2:
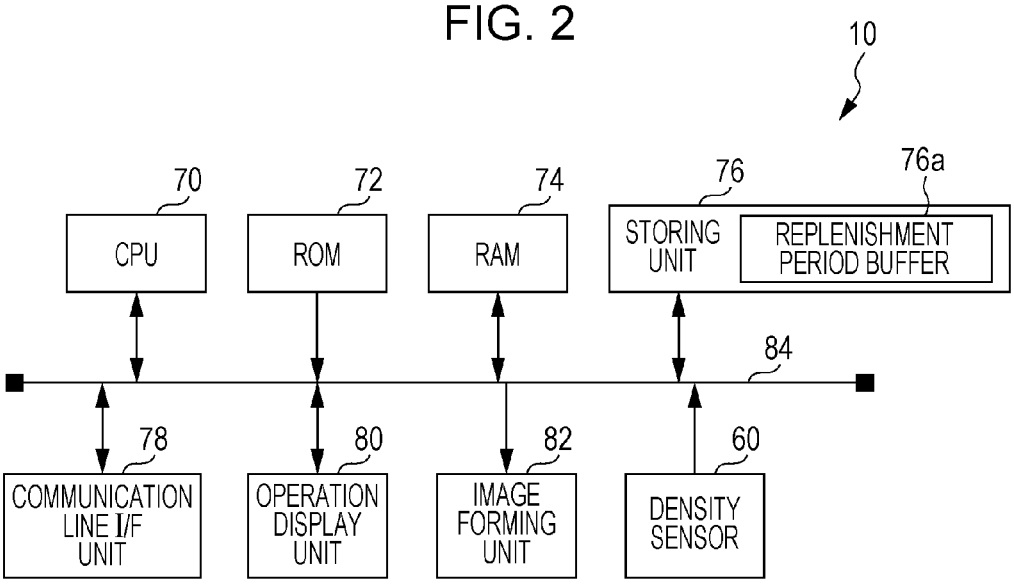
FIG. 2 is a block diagram illustrating a configuration of electrical principal portions of an image forming apparatus according to an exemplary embodiment.

As illustrated in FIG. 2, the image forming apparatus 10 according to the first exemplary embodiment includes a central processing unit (CPU) 70 which controls the overall operation of the image forming apparatus 10, and a read only memory (ROM) 72 in which various programs, various parameters, and the like are stored in advance. The image forming apparatus 10 also includes a random access memory (RAM) 74 which is used as a work area or the like for execution of the various programs by the CPU 70, and a nonvolatile storing unit 76 such as a flash memory.

The image forming apparatus 10 includes a communication line interface (I/F) unit 78 which performs transmission and reception of communication information to and from an external apparatus. The image forming apparatus 10 also includes an operation display unit 80 which receives an instruction from a user to the image forming apparatus 10 and notifies the user of various types of information regarding the operation conditions or the like of the image forming apparatus 10. The operation display unit 80 includes, for example, a touch panel display on which display buttons for implementing reception of operation instructions by execution of a program and various types of information are displayed, and hardware keys such as ten keys and a start button.

The image forming apparatus 10 also includes an image forming unit 82. The image forming unit 82 includes component parts which perform various types of processing regarding image formation of the image forming processing described above.

The CPU 70, the ROM 72, the RAM 74, the storing unit 76, the communication line I/F unit 78, the operation display unit 80, the image forming unit 82, and the density sensor 60 are connected to one another through a bus 84 including an address bus, a data bus, a control bus, and the like.

Thus, in the image forming apparatus 10 according to the first exemplary embodiment, the CPU 70 accesses the ROM 72, the RAM 74, and the storing unit 76, and performs transmission and reception of communication information through the communication line I/F unit 78. In the image forming apparatus 10, the CPU 70 also acquires various types of information through the operation display unit 80 and displays various types of information on the operation display unit 80. In the image forming apparatus 10, the CPU 70 forms images through the image forming unit 82. Furthermore, the image forming apparatus 10 acquires a value detected by the density sensor 60 as a density value which indicates the density of a toner image.

In the first exemplary embodiment, a toner image is formed by using a two-component developer which is made by mixing magnetic carriers with toner. The magnetic carriers are formed by coating fine particle magnetic powder such as iron or ferrite with a resin, and have a role to frictionally charge toner and a role to convey the toner to the photoreceptors 12. Then, after being electrically charged by friction with the magnetic carriers and electrostatically attracted to the photoreceptors 12, the toner is transferred to the intermediate transfer belt 22. At this time, the magnetic carriers are collected and reused, while the toner is consumed. Therefore, the mixture ratio of the toner to the magnetic carriers changes as image formation is repeated, and thus the toner density tends to vary. For the above reasons, for formation of a toner image using a two-component developer, normally, density correction processing is performed for correcting the replenishment amount of toner to be replenished to the developing devices 20 so that the toner density becomes a constant value.

In the first exemplary embodiment, in the density correction processing, the density sensor 60 optically detects the toner density to correct the replenishment amount of toner. Specifically, by applying high-intensity laser beams L corresponding to a predetermined reference density which is set in advance as a toner density to be used for correcting the toner density to the photoreceptors 12, toner images (patches) for correction of the toner density are formed on the photoreceptors 12. Furthermore, the density sensor 60 detects the toner density of the patch transferred to the intermediate transfer belt 22. Then, the replenishment amount of toner is corrected so that a difference between the detection value of the density sensor 60 and a target value of the density sensor 60 may be cancelled out.

That is, if the detected toner density is lower than the reference density, the deficiency amount of toner with respect to the reference density is calculated, and a value obtained by adding the deficiency amount of toner to the consumed toner replenishment amount for replenishing the toner consumed for forming the toner image is defined as an adjustment toner replenishment amount. If the detected toner density is higher than the reference density, the excess amount of toner with respect to the reference density is calculated, and a value obtained by subtracting the excess amount of toner from the consumed toner replenishment amount is defined as the adjustment toner replenishment amount. If the detected density is equal to the reference density, the consumed toner replenishment amount is defined as the adjustment toner replenishment amount. As described above, the density sensor 60 is a reflective-type optical sensor which includes a light-emitting element and a light-receiving element. The density sensor 60 applies light to the intermediate transfer belt 22, so that the toner density may be determined based on the reflectance. Therefore, a lower toner density results in a higher reflectance, and the detection value of the density sensor 60 increases. A higher toner density results in diffused reflection of irradiation light, and the detection value of the density sensor 60 decreases. That is, the size relationship is reversed between the toner density and the detection value of the density sensor 60.

During a toner replenishment period which is obtained based on the replenishment amount of toner and the replenishment speed of toner, toner replenishment processing for replenishing the amount of toner corresponding to the toner replenishment amount to the developing device 20 is performed by rotating the screw of the toner replenishment tank 21.

Figure 3:
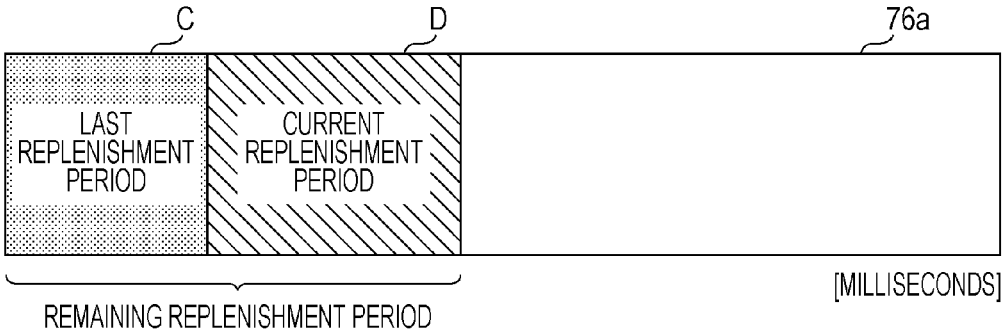
FIG. 3 is a schematic diagram illustrating a replenishment period buffer according to an exemplary embodiment.

The storing unit 76 includes a replenishment period buffer **76*a* that stores a toner replenishment period for each of the developing devices 20. For example, as illustrated in FIG. 3, the replenishment period buffer 76*a*** stores, for every time that the toner replenishment period is calculated, the calculated toner replenishment period. The remaining replenishment period, which is a stored replenishment period, decreases in accordance with the elapsed time since start of toner replenishment, that is, the toner replenishment amount.

That is, the remaining replenishment period corresponds to the amount of toner which is to be replenished to the developing device 20 and remains in the toner replenishment tank 21 without being replenished to the developing device 20. In the example illustrated in FIG. 3, a period obtained by adding the newly calculated toner replenishment period (the current replenishment period D) to the remaining replenishment period (the last replenishment period C) of the replenishment period calculated last time is stored as the remaining replenishment period. While the remaining replenishment period is stored in the replenishment period buffer **76*a***, the remaining replenishment period decreases in accordance with the toner replenishment amount, and the toner replenishment processing is continuously executed until the remaining replenishment period reaches 0.

In the case where plural images with high area coverage are consecutively formed, or the like, the toner consumption temporarily increases. However, since the toner replenishment speed is constant, replenishment of toner may not catch up with the consumption of toner, and the toner density of a toner image formed may thus be reduced.

In the first exemplary embodiment, during the period in which image forming processing is performed, control is performed so that replenishment of toner may catch up with consumption of toner, by temporarily stopping formation of images and performing idling processing for stirring toner in the developing device 20, while toner being replenished to the developing device 20 in accordance with the remaining replenishment period.

Figure 4A:
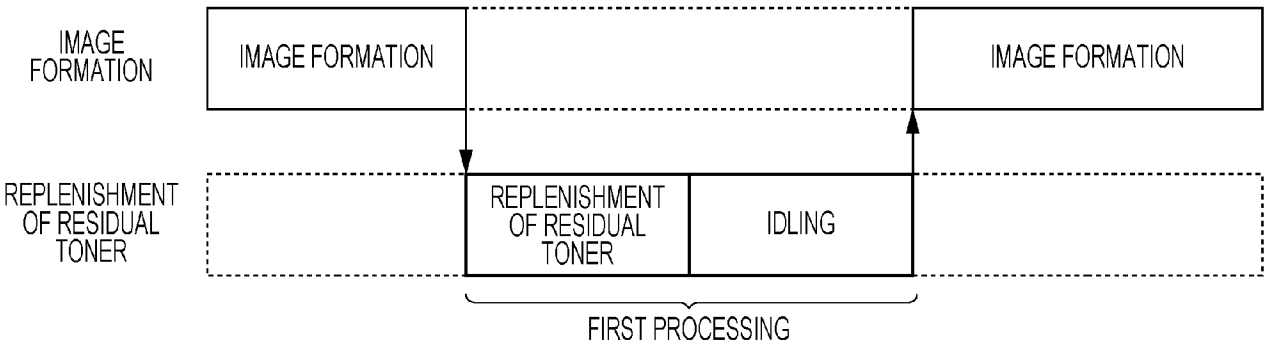
FIG. 4A is a schematic diagram illustrating first processing according to an exemplary embodiment.
Figure 4B:
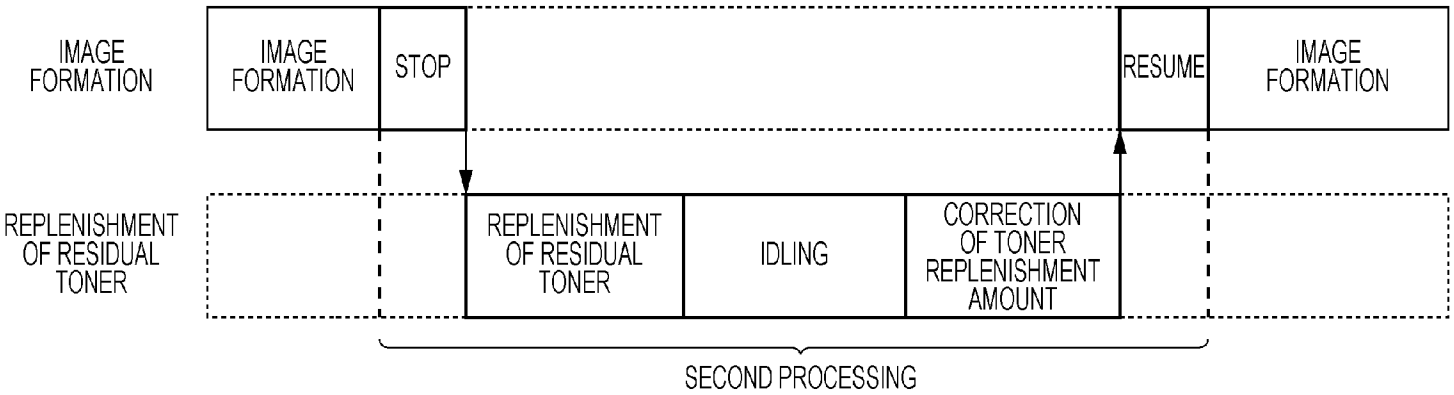
FIG. 4B is a schematic diagram illustrating second processing according to an exemplary embodiment.

In the first exemplary embodiment, during the period in which image forming processing is performed, an idling control process for switching between first processing, in which toner replenishment processing of residual toner and idling processing are performed, and second processing, in which the toner replenishment processing of residual toner, the idling processing, and the above-described density correction processing are performed, is performed. In the first processing, for example, as illustrated in FIG. 4A, formation of images is temporarily stopped, and after the toner replenishment processing of residual toner and the idling processing are performed during the time corresponding to the remaining replenishment period, formation of images continues to be performed again. In the second processing, for example, as illustrated in FIG. 4B, formation of images is stopped, the toner replenishment processing of residual toner and the idling processing are performed during the period corresponding to the remaining replenishment period, and after the above-described density correction processing is performed, formation of images is resumed again.

As described above, only the toner replenishment processing of residual toner and the idling processing are performed in the first processing, whereas the density correction processing is performed, in addition to the toner replenishment processing of residual toner and the idling processing, in the second processing. Therefore, it is preferable that the second processing is performed a larger number of times, in order to increase the quality of an image to be formed. However, since driving of a motor or the like for the photoreceptor 12 which is used for formation of an image is temporarily stopped in order to perform the density correction processing in the second processing, it is preferable that the first processing is performed a larger number of times, in order to increase the productivity of formation of images. In the first exemplary embodiment, taking into consideration the advantages and disadvantages of the first processing and the second processing, both the improvement in the quality of an image to be formed and the increase in the productivity of image formation may be achieved by adjusting the number of execution times of the first processing and the number of execution times of the second processing.

Figure 5:
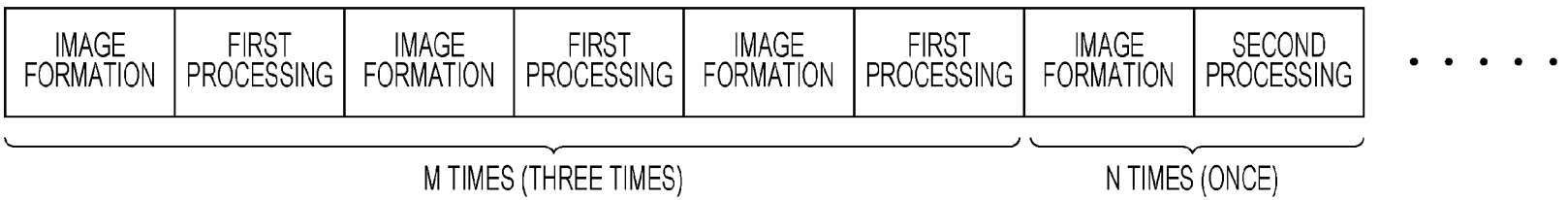
FIG. 5 is a schematic diagram illustrating an example of the execution order of first processing and second processing in an idling control process according to an exemplary embodiment.

In the first exemplary embodiment, for the idling processing, for example, as illustrated in FIG. 5, after the first processing is performed a predetermined maximum number M of times, switching to the second processing is performed. Then, the second processing is performed a predetermined maximum number N of times, and after that, processing for switching to the first processing is performed. The above switching between the first processing and the second processing is performed in a repeated manner. In the first exemplary embodiment, the case where M is set to 3 and N is set to 1 will be explained below.

Figure 6:
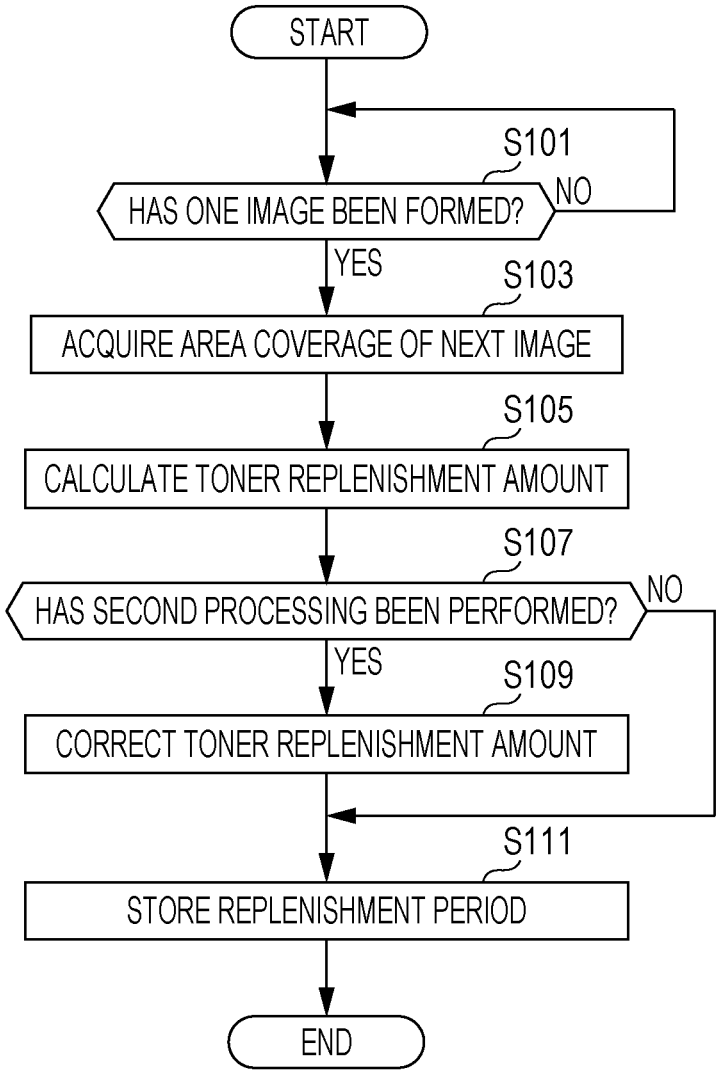
FIG. 6 is a flowchart illustrating the flow of a process of a toner replenishment instruction processing program according to an exemplary embodiment.

Next, the flow of a process performed by the CPU 70 of the image forming apparatus 10 according to the first exemplary embodiment for a toner replenishment instruction process which is started at a time when image forming processing for forming an image on the paper P is performed and performed in a repeated manner, will be explained with reference to a flowchart of FIG. 6. In the first exemplary embodiment, a program of the toner replenishment instruction process is stored in advance in the storing unit 76. However, the present invention is not limited to this. For example, the program of the toner replenishment instruction process may be received from an external apparatus via the communication line I/F unit 78 and stored in the storing unit 76. Furthermore, the toner replenishment instruction process may be performed when the program of the toner replenishment instruction process recorded in a recording medium such as a compact disc read-only memory (CD-ROM) is read by a CD-ROM drive or the like through the communication line I/F unit 78.

In step S101, it is determined whether or not an image has been formed in the image forming processing. When it is determined in step S101 that an image has been formed (S101; Yes), the process proceeds to step S103. When it is determined in step S101 that no image has been formed (S101; No), the processing of step S101 is performed again.

In step S103, the area coverage of the next image to be formed is acquired. In the first exemplary embodiment, image information of the next image to be formed is acquired, and the area coverage is calculated which represents the ratio of the area in which rendering is to be performed by toner to the whole area of an image formation region.

In step S105, the replenishment amount of toner is calculated. In the first exemplary embodiment, the amount of toner to be used for rendering of the next image is calculated from the area coverage of the next image, and the calculated amount of toner is defined as the toner replenishment amount.

In step S107, it is determined whether or not the second processing has been performed in the idling control process, which will be described later. When it is determined in step S107 that the second processing has been performed (S107; Yes), the process proceeds to step S109. When it is determined in step S107 that the second processing has not been performed (S107; No), the process proceeds to step S111.

In step S109, the toner replenishment amount calculated in step S105 is corrected based on the correction amount of the toner replenishment amount calculated in the second processing (see step S241, which will be described later).

In step S111, the toner replenishment period corresponding to the toner replenishment amount is stored in the replenishment period buffer 76*a*. Thus, an instruction for replenishing toner to the developing device 20 is issued. In the case where the replenishment amount of toner is corrected in step S109, the toner replenishment period corresponding to the corrected replenishment amount of toner is stored in the replenishment period buffer 76*a*. During the period in which the remaining replenishment period is stored in the replenishment period buffer 76*a*, the remaining replenishment period decreases in accordance with the replenishment amount of toner, and the toner replenishment processing continues to be performed until the remaining replenishment period reaches 0.

Figure 7A:
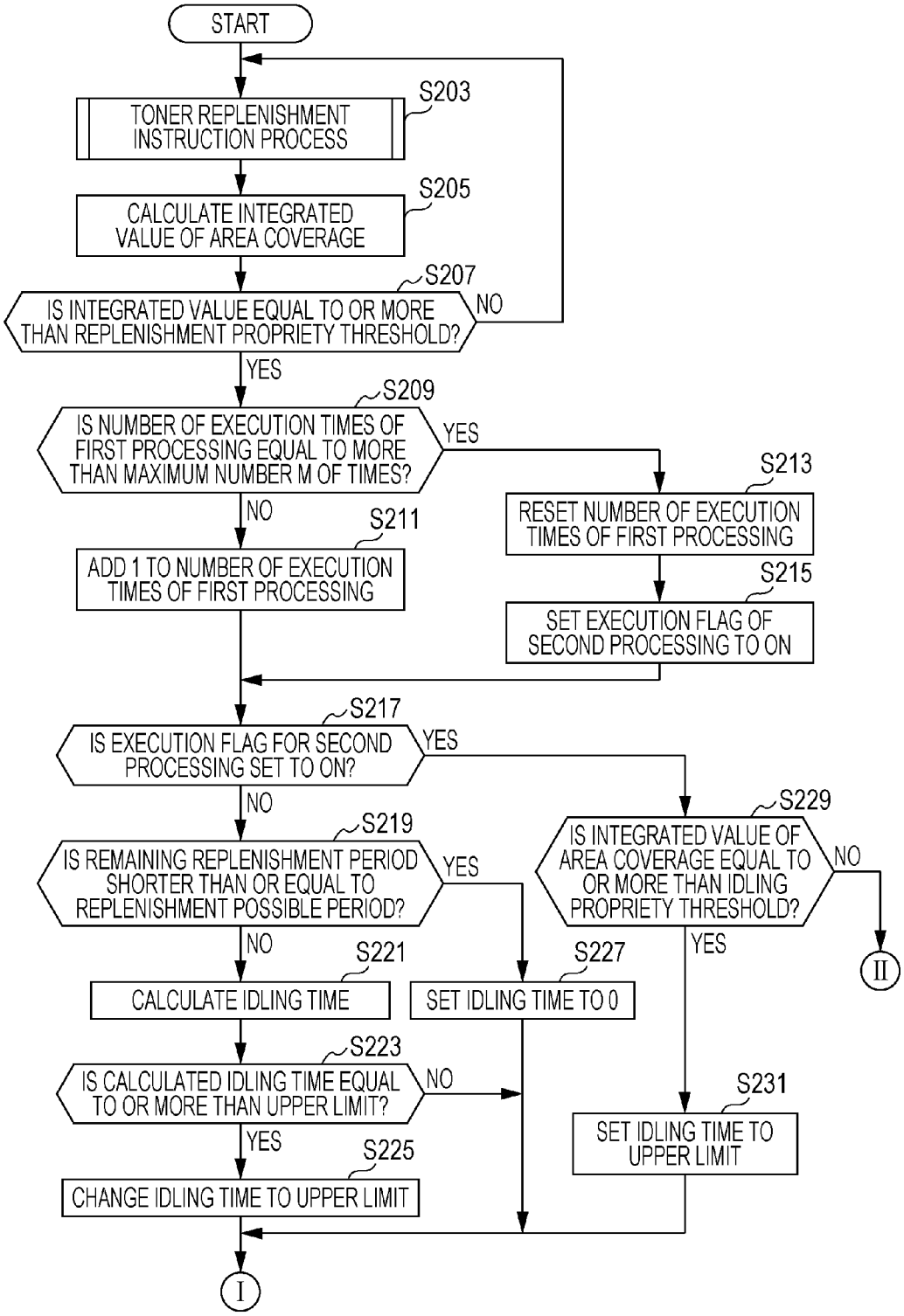
FIGS. 7A and 7B are flowcharts illustrating the flow of a process of an idling control processing program according to an exemplary embodiment.
Figure 7B:
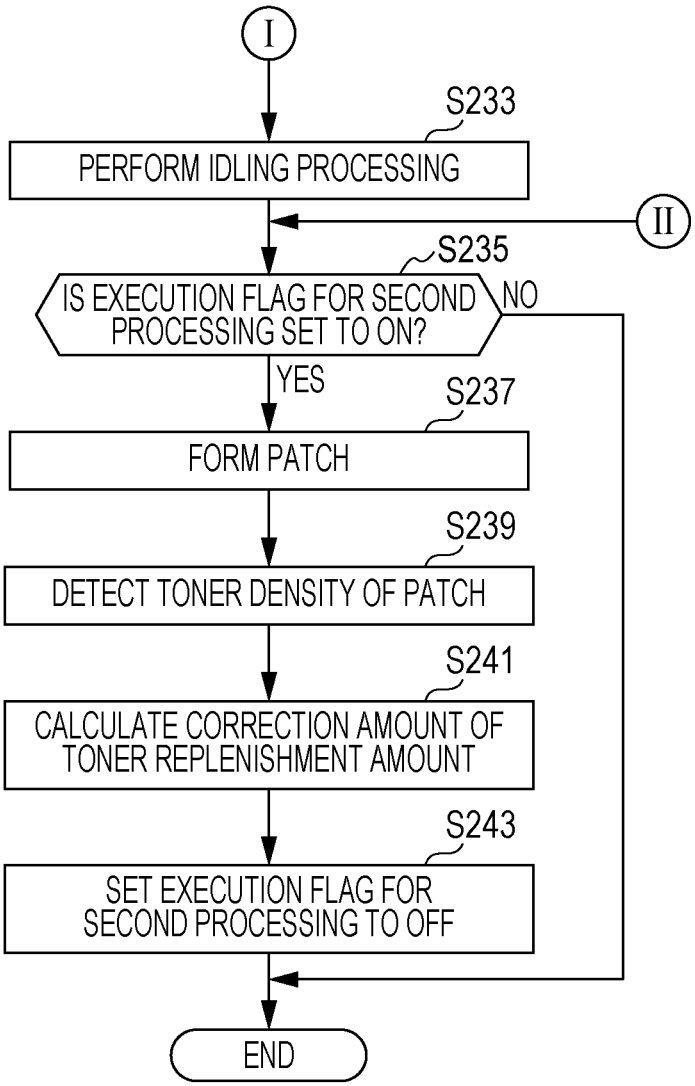

Next, the flow of a process performed by the CPU 70 of the image forming apparatus 10 according to the first exemplary embodiment for an idling control process which is started at a time when image forming processing for forming an image on the paper P is performed and performed in a repeated manner, will be explained with reference to the flowcharts of FIGS. 7A and 7B. In the first exemplary embodiment, a program of the idling control process is stored in advance in the storing unit 76. However, the present invention is not limited to this. For example, the program of the idling control process may be received from an external apparatus via the communication line I/F unit 78 and stored in the storing unit 76. Furthermore, the idling control process may be performed when the program of the idling control process recorded in a recording medium such as a CD-ROM is read by a CD-ROM drive or the like through the communication line I/F unit 78.

In the first exemplary embodiment, information which indicates the number of execution times of the first processing and the integrated value of area coverage are sequentially stored in the storing unit 76. Furthermore, in the first exemplary embodiment, information which indicates whether the execution flag for the second processing is set to on or set to on is stored in the storing unit 76. In the case where the execution flag for the second processing is set to off, the first processing is performed. In the case where the execution flag for the second processing is set to on, the second processing is performed. In the first exemplary embodiment, the case where the execution flag for the second processing is set to off at the time when the toner replenishment processing program is executed will be explained.

First, in step S203, the above-described toner replenishment instruction process is performed.

In step S205, the integrated value of area coverage of images to be formed is calculated. In the first exemplary embodiment, the integrated value of area coverage is calculated by adding the area coverage of the next image to be formed to the integrated value of area coverage stored in the storing unit 76. Furthermore, the calculated integrated value is stored in the storing unit 76 as the latest integrated value of area coverage.

In step S207, it is determined whether or not the calculated integrated value of area coverage is equal to or more than a replenishment propriety threshold which is a criterion for determining whether or not replenishment of toner is required. In the first exemplary embodiment, when the consumption of toner reaches a predetermined amount, it is determined that replenishment of toner is required. The replenishment propriety threshold corresponds to the lower limit of consumption of toner required for toner replenishment. When it is determined in step S207 that the integrated value of area coverage is equal to or more than the replenishment propriety threshold (S207; Yes), the process proceeds to step S209. When it is determined in step S207 that the integrated value of area coverage is less than the replenishment propriety threshold (S207; No), the process returns to step S201.

In step S209, it is determined whether or not the number of execution times of the first processing is equal to or more than the maximum number M of times of the first processing. When it is determined in step S209 that the number of execution times of the first processing is equal to or more than the maximum number M of times of the first processing (S209; Yes), the process proceeds to step S213 to perform the second processing. When it is determined in step S209 that the number of execution times of the first processing is less than the maximum number M of times of the first processing (S209; No), the process proceeds to step S211 to perform the first processing.

In step S211, the number of execution times of the first processing is incremented by 1, and the process proceeds to step S217.

Meanwhile, in step S213, the number of execution times of the first processing is reset to 0. In step S215, the execution flag for the second processing is set to on, and the process proceeds to step S217.

In step S217, it is determined whether or not the execution flag for the second processing is set to on. When it is determined in step S217 that the execution flag for the second processing is set to on (S217; Yes), the process proceeds to step S229. When it is determined in step S217 that the execution flag for the second processing is set to off (S217; No), the process proceeds to step S219.

In step S219, it is determined whether or not the remaining replenishment period is shorter than or equal to a replenishment possible period X0 which represents an upper limit of the range of the remaining replenishment period in which stirring is not required because the amount of the residual toner is small. When it is determined in step S219 that the remaining replenishment period is shorter than or equal to the replenishment possible period X0 (S219, Yes), the process proceeds to step S227. When it is determined in step S219 that the remaining replenishment period is longer than the replenishment possible period X0 (S219; No), the process proceeds to step S221.

In step S221, the idling time during which idling processing is performed is calculated based on the amount of residual toner, that is, the remaining replenishment period. The idling time is a time required for toner discharged into the developing device 20 to be stirred by the stirring member so that the toner density becomes uniform, and is determined based on the amount of toner discharged into the developing device 20. In the first exemplary embodiment, for example, the idling time is calculated, as represented by a section R1 (X1>remaining replenishment period>X0) in FIG. 8, such that the idling time increases as the difference obtained from subtracting the replenishment possible period X0 from the remaining replenishment period increases.

In step S223, it is determined whether or not the calculated idling time is equal to or more than an upper limit of the allowable range of the productivity of image formation. In the first exemplary embodiment, information which indicates the upper limit is input in advance by the operation display unit 80 and stored in the storing unit 76. When it is determined in step S223 that the idling time is equal to or more than the upper limit (S223; Yes), the process proceeds to step S225. When it is determined in step S223 that the idling time is less than the upper limit (S223; No), the process proceeds to step S233.

Figure 8:
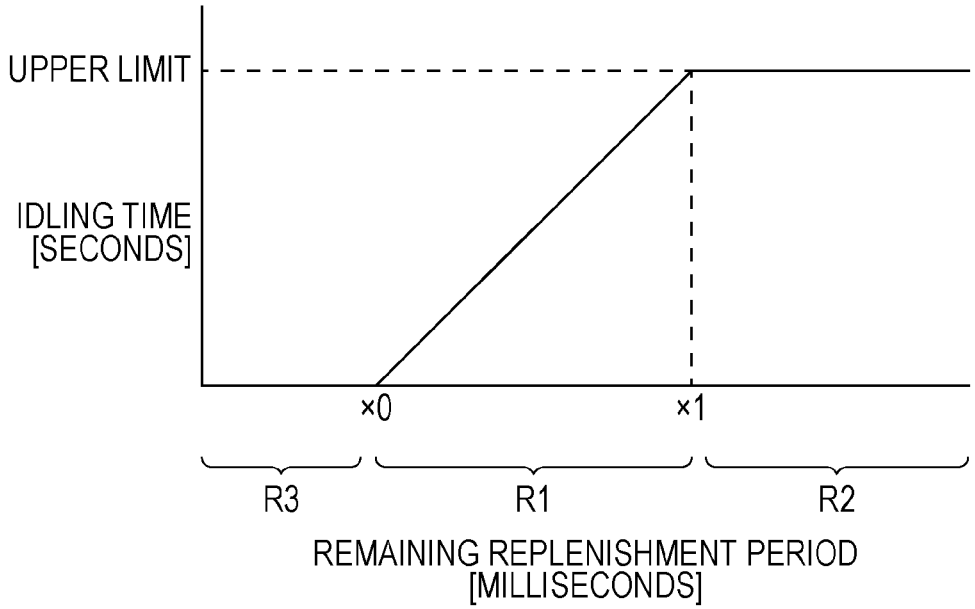
FIG. 8 is a graph illustrating an example of the relationship between a remaining replenishment period and an idling time according to an exemplary embodiment.

In step S225, for example, as represented by a section R2 (remaining replenishment period≥X1) in FIG. 8, the calculated idling time is changed to the upper limit value. Accordingly, the upper limit is provided to the idling time, and the productivity of image formation may be prevented from decreasing. The remaining replenishment period X1 represents the remaining replenishment period in which the idling time is maximum in the section R1.

In step S227, for example, as represented by a section R3 (X0≥remaining replenishment period), the idling time is set to 0.

Meanwhile, in step S229, it is determined whether or not the integrated value of area coverage of images that are to be consecutively formed is equal to or more than an idling propriety threshold which is a criterion for determining whether or not idling processing is required. That is, as the area coverage of images to be consecutively formed in accordance with an execution instruction for image formation increases, the speed of toner consumption increases, whereas the speed of toner replenishment is constant. Therefore, if the area coverage of images to be consecutively formed is high, idling processing is required. In the first exemplary embodiment, the idling propriety threshold is, for example, an area coverage that is one-tenth of the amount of toner that may be stored inside the developing device 20, and information which indicates the idling propriety threshold is stored in advance in the storing unit 76.

When it is determined in step S229 that the integrated value of area coverage of images to be consecutively formed is equal to or more than the idling propriety threshold (S229; Yes), the process proceeds to step S231 to perform idling processing. When it is determined in step S229 that the integrated value of area coverage of images to be consecutively formed is less than the idling propriety threshold (S229; No), the idling processing is not required, and the process proceeds to step S235.

In step S231, the idling time is set to the upper limit value in order to perform the density correction processing with high accuracy in the second processing.

In step S233, idling processing is performed for the idling time set in any of step S221, S225, S227, and S231. While the idling processing is being performed, toner is not consumed because no image is formed, but toner replenishment processing of residual toner is performed for the developing device 20. Accordingly, by the toner replenishment processing of residual toner, at least part of residual toner is replenished to the developing device 20, and the toner density of replenished toner is made uniform by the idling processing.

In step S235, it is determined whether or not the execution flag for the second processing is set to on. When it is determined in step S235 that the execution flag for the second processing is set to on (S235; Yes), the process proceeds to step S237. When it is determined in step S235 that the execution flag for the second processing is not set to on (S235; No), the execution of the toner replenishment processing program ends.

In step S237, the image forming unit 82 is controlled so that a patch is formed on the photoreceptor 12. In step S239, the density sensor 60 detects the toner density of the patch transferred from the photoreceptor 12 to the intermediate transfer belt 22.

In step S241, based on the detection value of the density sensor 60, the correction amount of toner replenishment amount is calculated. The correction amount of toner replenishment amount calculated in step S241 is used to correct the toner replenishment amount in step S109 described above.

In step S241, the execution flag for the second processing is switched to off, and the execution of the toner replenishment processing program ends.

In the first exemplary embodiment, the case where the maximum number M of times of the first processing is set to 3 and the maximum number N of times of the second processing is set to 1 has been described. However, the present invention is not limited to this. For example, the maximum number N of times of the second processing may be set to 1, and the maximum number M of times of the first processing may be set to be decreased as the area coverage of an image formed in each piece of paper P increases. Furthermore, the maximum number M of times of the first processing and the maximum number N of times of the second processing may be set such that the execution frequency of the second processing becomes higher than the execution frequency of the first processing as the area coverage of an image formed in each piece of paper P increases.

Furthermore, in the first exemplary embodiment, the case where the maximum number M of times of the first processing is set to 3 and the maximum number N of times of the second processing is set to 1 has been described. However, the present invention is not limited to this. As the number of images to be consecutively formed in accordance with an execution instruction for image formation decreases, the motor of the screw of the toner replenishment tank 21 is switched between on and off more frequently. Thus, the remaining replenishment period decreases, and toner replenishment is performed without delay. That is, toner replenishment is more likely to be delayed as the number of images to be consecutively formed increases. Thus, for example, the maximum number M of times of the first processing and the maximum number N of times of the second processing may be set such that the execution frequency of the second processing becomes higher than the execution frequency of the first processing as the number of images to be consecutively formed in accordance with an execution instruction for image formation increases.

In the first exemplary embodiment, the case where the maximum number M of times of the first processing is set to 3 and the maximum number N of times of the second processing is set to 1 has been described. However, the present invention is not limited to this. For example, taking into consideration that toner is more likely to be deteriorated as the apparatus temperature increases, the maximum number M of times of the first processing and the maximum number N of times of the second processing may be set such that the execution frequency of the second processing becomes higher than the execution frequency of the first processing as the apparatus temperature increases.

In the first exemplary embodiment, the case where the idling time in the second processing is set to the upper limit value in step S231 has been described. However, the present invention is not limited to this. For example, as in step S221, the idling time in the second processing may be calculated based on the remaining replenishment period.

Furthermore, in the first exemplary embodiment, the case where it is determined in step S209 whether the number of execution times of the first processing is equal to or more than the maximum number M of times of the first processing has been described. However, the present invention is not limited to this. In step S209, for example, it may be determined whether, instead of the number of execution times of the first processing, the integrated value of area coverage of images to be formed is equal to or more than a predetermined threshold. In this case, when the integrated value of area coverage of images to be formed is equal to or more than the predetermined threshold, the process proceeds to step S213, and the execution flag for the second processing is set to on. Furthermore, the predetermined threshold may be obtained by, for example, multiplying the average of area coverage of images to be formed on the paper P by a predetermined number of pieces of paper (for example, 10 pieces of paper).

Furthermore, in the first exemplary embodiment, the case where it is determined in step S207 whether or not the integrated value of area coverage is equal to or more than a replenishment propriety threshold has been described. However, the present invention is not limited to this. In step S207, for example, it may be determined whether or not, instead of the integrated value of area coverage, the remaining replenishment period is equal to or more than a predetermined threshold. In this case, when the remaining replenishment period is equal to or more than the predetermined threshold, the process proceeds to step S209, and the first processing or the second processing is performed. Furthermore, the predetermined threshold may be, for example, set to the replenishment possible time X0. When the remaining replenishment period is less than the predetermined threshold, the execution flag for the second processing may be set to on, so that only the second processing may be performed.

Furthermore, in the first exemplary embodiment, the case where the maximum number N of times of the second processing is set to 1 has been described. However, the present invention is not limited to this. The maximum number N of times of the second processing may be set to 2 or more. In this case, in step S243, when the execution number of times of the second processing is equal to or more than the maximum number N of times, the execution flag for the second processing may be set to off.

Furthermore, in each of the foregoing exemplary embodiments, the case where each step of the toner replenishment processing is implemented through software configuration using a computer by execution of a program has been described. However, the present invention is not limited to this. For example, each of the steps may be implemented through hardware configuration or a combination of hardware configuration and software configuration.

In addition, the configuration of the image forming apparatus 10 described in each of the foregoing exemplary embodiments (see FIGS. 1 and 2) is merely an example. Obviously, deletion of unnecessary portions and addition of new portions may be made without departing from the scope of the present invention.

Furthermore, the flow of processes of various programs described in each of the foregoing exemplary embodiments (see FIGS. 6 and 7) is merely an example. Obviously, deletion of unnecessary steps, addition of new steps, and changing of the processing order may be made without departing from the scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image forming unit that forms an electrostatic latent image corresponding to an image information signal on an image carrier;

a developing unit that develops the electrostatic latent image using a two-component developer in which magnetic carriers are mixed with toner to form a visible image;

a replenishing unit that replenishes the toner to the developing unit; and a control unit that controls switching between first processing and second processing, the first processing including idling processing for replenishing at least part of residual toner, which is to be replenished to the developing unit and remains without being replenished to the developing unit, to the developing unit and stirring the toner within the developing unit, the second processing including the idling processing and density correction processing for correcting a density of the toner within the developing unit wherein in a case where an integrated value of area coverage of a plurality of images to be consecutively formed is less than an idling propriety threshold, which is a criterion for determining whether or not the idling processing is required, the control unit performs control such that the density correction processing is performed without the idling processing being performed in the second processing.

2. The image forming apparatus according to claim 1, wherein the control unit performs control such that an execution frequency of the first processing becomes higher than an execution frequency of the second processing.

3. The image forming apparatus according to claim 1, wherein the control unit performs control such that an execution frequency of the second processing becomes higher than an execution frequency of the first processing as an area coverage of an image to be formed increases.

4. The image forming apparatus according to claim 1, wherein the control unit performs control such that an execution frequency of the second processing becomes higher than an execution frequency of the first processing as a number of images to be consecutively formed increases.

5. The image forming apparatus according to claim 1, wherein in the first processing, in a case where an amount of the residual toner is less than or equal to a replenishment possible threshold, which is a criterion for determining whether or not replenishment of the residual toner is required, the control unit does not perform the idling processing.

6. The image forming apparatus according to claim 1, wherein an idling time during which the idling processing is performed is a time corresponding to an amount of the residual toner.

7. The image forming apparatus according to claim 6, wherein in a case where the idling time during which the idling processing is performed is equal to or more than a predetermined upper limit of an allowable range of a productivity of image formation, the idling time is set to the upper limit value.

8. The image forming apparatus according to claim 1, further comprising:

a detector that detects a density of the visible image, wherein the density correction processing is processing for causing the detector to detect the density of the visible image of a density correction image that is an electrostatic latent image for density correction on the image carrier, and causing the replenishing unit to correct a replenishment amount of the toner in accordance with the detected density.

9. An image forming method comprising:

forming an electrostatic latent image corresponding to an image information signal on an image carrier;

developing the electrostatic latent image using a two-component developer in which magnetic carriers are mixed with toner to form a visible image;

replenishing the toner to the developing unit; and controlling switching between first processing and second processing, the first processing including idling processing for replenishing at least part of residual toner, which is to be replenished to the developing unit and remains without being replenished to the developing unit, to the developing unit and stirring the toner within the developing unit, the second processing including the idling processing and density correction processing for correcting a density of the toner within the developing unit, wherein in a case where an integrated value of area coverage of a plurality of images to be consecutively formed is less than an idling propriety threshold, which is a criterion for determining whether or not the idling processing is required, the density correction processing is performed without the idling processing being performed in the second processing.

10. A non-transitory computer readable medium storing a program causing a computer to execute a process for image formation, the process comprising:

forming an electrostatic latent image corresponding to an image information signal on an image carrier;

developing the electrostatic latent image using a two-component developer in which magnetic carriers are mixed with toner to form a visible image;

replenishing the toner to the developing unit; and controlling switching between first processing and second processing, the first processing including idling processing for replenishing at least part of residual toner, which is to be replenished to the developing unit and remains without being replenished to the developing unit, to the developing unit and stirring the toner within the developing unit, the second processing including the idling processing and density correction processing for correcting a density of the toner within the developing unit, wherein in a case where an integrated value of area coverage of a plurality of images to be consecutively formed is less than an idling propriety threshold, which is a criterion for determining whether or not the idling processing is required, the density correction processing is performed without the idling processing being performed in the second processing.

* * * * *